US009959795B2

(12) United States Patent
Kim et al.

(10) Patent No.: US 9,959,795 B2
(45) Date of Patent: May 1, 2018

(54) DISPLAY DEVICE AND METHOD OF DRIVING THE SAME

(71) Applicant: Samsung Display Co., Ltd., Yongin-si, Gyeonggi-do (KR)

(72) Inventors: Mincheol Kim, Yongin-si (KR); Inhwan Kim, Yongin-si (KR); Byunggeun Jun, Yongin-si (KR); Uiyeong Cha, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 95 days.

(21) Appl. No.: 14/843,888

(22) Filed: Sep. 2, 2015

(65) Prior Publication Data

US 2016/0232876 A1 Aug. 11, 2016

(30) Foreign Application Priority Data

Feb. 9, 2015 (KR) ..... 10-2015-0019729

(51) Int. Cl.
*G09G 5/10* (2006.01)
*G09G 3/00* (2006.01)

(52) U.S. Cl.
CPC ..... *G09G 3/001* (2013.01); *G09G 2320/0686* (2013.01); *G09G 2370/08* (2013.01)

(58) Field of Classification Search
CPC combination set(s) only.
See application file for complete search history.

(56) References Cited

U.S. PATENT DOCUMENTS

2005/0069209 A1* 3/2005 Damera-Venkata ... G09G 3/007 382/204
2011/0285758 A1* 11/2011 Matsushita ..... G09G 3/3426 345/690
2013/0069974 A1 3/2013 Lee et al.
2014/0078333 A1* 3/2014 Miao ..... H04N 5/23212 348/222.1
2014/0168289 A1* 6/2014 Shibata ..... G09G 3/3688 345/690
2014/0184671 A1 7/2014 Lee

FOREIGN PATENT DOCUMENTS

KR 10-2013-0077044 A 7/2013
KR 10-2014-0067129 A 6/2014
KR 10-2014-0081393 A 7/2014
KR 10-2014-0086619 A 7/2014

* cited by examiner

*Primary Examiner* — Carolyn R Edwards
*Assistant Examiner* — Deeprose Subedi
(74) *Attorney, Agent, or Firm* — Knobbe, Martens, Olson & Bear, LLP

(57) ABSTRACT

A display device and a method of driving the same are disclosed. In one aspect, the display device includes a display panel including a plurality of pixels including a first group of pixels and a second group of pixels. The first group of pixels forms a first region and the second group of pixels forms a second region surrounding the first region. A controller is configured to receive input image data, process the input image data corresponding to the first pixels based on a preset first image processing algorithm so as to generate first modified image data, and process the input image data corresponding to the second pixels based on a preset second image processing algorithm so as to generate second modified image data.

16 Claims, 8 Drawing Sheets

DISPLAY DEVICE AND METHOD OF DRIVING THE SAME

RELATED APPLICATION

This application claims the benefit of Korean Patent Application No. 10-2015-0019729, filed on Feb. 9, 2015, in the Korean Intellectual Property Office, the disclosure of which is incorporated herein in its entirety by reference.

BACKGROUND

Field

The described technology generally relates to display devices and methods of driving the display devices.

Description of the Related Technology

A display device can convey visual information to its users. Examples of display devices include cathode ray tube displays, liquid crystal displays (LCDs), field emission displays, plasma displays, and organic light-emitting diode (OLED) displays. Due to various reasons such as characteristics of a display device or imbalance of pixels generated in a process, optical compensation can be applied to image data.

SUMMARY OF CERTAIN INVENTIVE ASPECTS

One inventive aspect relates to a display device performing optical compensation by applying an image processing algorithm that is determined based on positions of pixels corresponding to image data, to the image data, and a method of driving the display device.

Another aspect is a display device that includes: a display unit comprising a plurality of pixels including first and second pixels; a first region in which the first pixels are formed; and a second region which surrounds the first region, without overlapping the first region, and in which the second pixels are formed; and a controller generating first modified image data by applying a preset first image processing algorithm to process image data corresponding to the first pixels, from among input image data, and generating second modified image data by applying a preset second image processing algorithm to process image data corresponding to the second pixels, from among the input image data.

The first image processing algorithm can include dividing the first pixels into a plurality of first pixel sets each formed of a first number of pixels and determining a plurality of first correction values respectively corresponding to the first pixel sets, and the second image processing algorithm can include dividing the second pixels into a plurality of second pixel sets each formed of a second number of pixels and determining a plurality of second correction values respectively corresponding to the second pixel sets, wherein the second number is larger than the first number.

The first image processing algorithm can include generating the first modified image data by multiplying each of the input image data respectively corresponding to the pixels included in the first pixel sets by the first correction value respectively corresponding to the first pixel sets, and the second image processing algorithm can include generating the second modified image data by multiplying each of the input image data respectively corresponding to the pixels included in the second pixel sets by the second correction value respectively corresponding to the second pixel sets.

Among the second pixels, the second image processing algorithm can include dividing second pixels formed in an outer portion of the second region into a plurality of second outer pixel sets formed of a number of pixels which is less than the second number.

The first image processing algorithm can include dividing the first pixels into a plurality of third pixel sets each formed of a third number of pixels and determining a plurality of first image processing masks respectively corresponding to the third pixel sets, and the second image processing algorithm can include dividing the second pixels into a plurality of fourth pixel sets each formed of a fourth number of pixels and determining a plurality of second image processing masks respectively corresponding to the fourth pixel sets, wherein the fourth number is larger than the third number.

The plurality of pixels can further include boundary pixels, and the display unit can include a boundary region in which the boundary pixels are formed, wherein the boundary region surrounds the first region, does not overlap the first and second regions, and is surrounded by the second region.

The boundary region can include a first boundary region and a second boundary region, and the controller can generate modified boundary image data by applying the first image processing algorithm to image data corresponding to pixels formed in the first boundary region, from among the input image data, and applying the second image processing algorithm to image data corresponding to pixels formed in the second boundary region, from among the input image data.

The first and second boundary regions can be arranged in the boundary region in a two-dimensional mosaic form.

The first region can be one of a circle, an oval, a square, and a polygonal shape, formed in a center portion of the display unit, and the boundary region can surround the first region, not overlap the first region, and be one of a circular ring, an oval ring, a square ring, and a polygonal ring shape, and the second region can surround the boundary region, not overlap the boundary region, and be one of a circular ring, an oval ring, a square ring, and a polygonal ring shape.

The first region can be one of a circle, an oval, a square, and a polygonal shape, formed in a center portion of the display unit, and the second region can surround the first region, not overlap the first region, and be one of a circular ring, an oval ring, a square ring, and a polygonal ring shape.

The display device can further include a display device fixing unit supporting the display device such that the display unit is located in front of at least one of the left and right eyes of a user.

Another aspect is a method of driving a display device, the display device including a display unit including a plurality of pixels including first and second pixels; a first region in which the first pixels are formed; and a second region in which the second pixels are formed; and a controller generating modified image data from input image data. The method can include: generating first modified image data by applying a preset first image processing algorithm to process image data corresponding to the first pixels, from among input image data, wherein the generating is performed by the controller; generating second modified image data by applying a preset second image processing algorithm to process image data corresponding to the second pixels, from among the input image data, wherein the generating is performed by the controller, wherein the second region does not overlap the first region but surrounds the first region.

The generating of the first modified image data can include dividing the first pixels into a plurality of first pixel sets each formed of a first number of pixels and determining a plurality of first correction values respectively corresponding to the first pixel sets, and the generating of the second modified image data can include dividing the second pixels into a plurality of second pixel sets each formed of a second number of pixels and determining a plurality of second correction values respectively corresponding to the second pixel sets, wherein the second number is larger than the first number.

The generating of the first modified image data can include generating the first modified image data by multiplying each of the input image data respectively corresponding to the pixels included in the first pixel sets by the first correction value respectively corresponding to the first pixel sets, and the generating of the second modified image data can include generating the second modified image data by multiplying each of the input image data respectively corresponding to the pixels included in the second pixel sets by the second correction value respectively corresponding to the second pixel sets.

The generating of the second modified image data can include, from among the second pixels, dividing second pixels formed in an outer portion of the second region into a plurality of second outer pixel sets formed of a number of pixels which is less than the second number.

The generating of the first modified image data can include dividing the first pixels into a plurality of third pixel sets each formed of a third number of pixels and determining a plurality of first image processing masks respectively corresponding to the third pixel sets, and the generating of the second modified image data can include dividing the second pixels into a plurality of fourth pixel sets each formed of a fourth number of pixels and determining a plurality of second image processing masks respectively corresponding to the fourth pixel sets, wherein the fourth number is larger than the third number.

The plurality of pixels can include boundary pixels, and the display unit can include a boundary region in which the boundary pixels are formed, wherein the boundary region surrounds the first region, does not overlap the first and second regions, and is surrounded by the second region, and the boundary region includes a first boundary region and a second boundary region, and the method can further include generating modified boundary image data by applying the first image processing algorithm to image data corresponding to pixels formed in the first boundary region, from among the input image data, and applying the second image processing algorithm to image data corresponding to pixels formed in the second boundary region, from among the input image data, wherein the generating is performed by the controller.

The first and second boundary regions can be arranged in the boundary region in a two-dimensional mosaic form.

The first region can be one of a circle, an oval, a square, and a polygonal shape, formed in a center portion of the display unit, and the boundary region can surround the first region, not overlap the first region, and be one of a circular ring, an oval ring, a square ring, and a polygonal ring shape, and the second region can surround the boundary region, not overlap the boundary region, and be one of a circular ring, an oval ring, a square ring, and a polygonal ring shape.

The first region can be one of a circle, an oval, a square, and a polygonal shape, formed in a center portion of the display unit, and the second region can surround the first region, not overlap the first region, and be one of a circular ring, an oval ring, a square ring, and a polygonal ring shape.

Another aspect is a display device, comprising: a display panel comprising a plurality of pixels including a first group of pixels and a second group of pixels, wherein the first group of pixels form a first region and the second group of pixels form a second region surrounding the first region; and a controller configured to i) receive input image data, ii) process the input image data corresponding to the first pixels based on a preset first image processing algorithm so as to generate first modified image data, and iii) process the input image data corresponding to the second pixels based on a preset second image processing algorithm so as to generate second modified image data.

In the above display device, the first image processing algorithm is configured to divide the first group pixels into a plurality of first pixel sets each including a first number of pixels and determine a plurality of first correction values respectively corresponding to the first pixel sets, wherein the second image processing algorithm is configured to divide the second group of pixels into a plurality of second pixel sets each including a second number of pixels and determine a plurality of second correction values respectively corresponding to the second pixel sets, and wherein the second number is greater than the first number.

In the above display device, the first image processing algorithm is further configured to multiply the input image data of each of the first pixel sets by the corresponding first correction value so as to generate the first modified image data, wherein the second image processing algorithm is further configured to multiply the input image data of each of the second pixel sets by the corresponding second correction value so as to generate the second modified image data.

In the above display device, the second image processing algorithm is further configured to divide the second group of pixels formed in an outer portion of the second region into a plurality of second outer pixel sets each including a number of the pixels which is less than the second number.

In the above display device, the first image processing algorithm is configured to divide the first group of pixels into a plurality of third pixel sets each including a third number of pixels and determine a plurality of first image processing masks respectively corresponding to the third pixel sets, wherein the second image processing algorithm is configured to divide the second group of pixels into a plurality of fourth pixel sets each including a fourth number of pixels and determine a plurality of second image processing masks respectively corresponding to the fourth pixel sets, and wherein the fourth number is greater than the third number.

In the above display device, the pixels further include a plurality of boundary pixels, wherein the boundary pixels form a boundary region, wherein the boundary region surrounds the first region and wherein the second region surrounds the boundary region.

In the above display device, the boundary region comprises a first boundary region including a plurality of first boundary pixels and a second boundary region including a plurality of second boundary pixels, wherein the controller is further configured to i) apply the first image processing algorithm to the input image data corresponding to the first boundary pixels and ii) apply the second image processing algorithm to the input image data corresponding to the second boundary pixels, so as to generate modified boundary image data.

In the above display device, the first and second boundary regions are formed in the boundary region in a mosaic form.

In the above display device, the first region is substantially circular, oval, square, or polygonal and formed in a center portion of the display panel, wherein the boundary region has the shape of a substantially circular ring, a substantially oval ring, a substantially square ring, or a polygonal ring, and wherein the second region has the shape of a substantially circular ring, a substantially oval ring, a substantially square ring, or a polygonal ring.

In the above display device, the first region is substantially circular, oval, square, or polygonal and formed in a center portion of the display panel, wherein the second region has the shape of a substantially circular ring, a substantially oval ring, a substantially square ring, or a polygonal ring.

The above display device further comprises a display device support configured to support the display device such that the display panel is located in front of at least one of the left and right eyes of a user of the display device.

Another aspect is a method of driving a display device, the display device comprising a display panel including a plurality of first pixels that form a first region and a plurality of second pixels that form a second region, the method comprising: receiving input image data at a controller electrically connected to the display panel and configured to generate modified image data from the input image data; first applying a preset first image processing algorithm to process the input image data corresponding to the first pixels via the controller so as to generate first modified image data; and second applying a preset second image processing algorithm to process the input image data corresponding to the second pixels via the controller so as to generate second modified image data, wherein the second region does not overlap the first region and surrounds the first region.

In the above method, the first applying comprises dividing the first pixels into a plurality of first pixel sets each formed of a first number of pixels and determining a plurality of first correction values respectively corresponding to the first pixel sets, wherein the second applying comprises dividing the second pixels into a plurality of second pixel sets each including a second number of pixels and determining a plurality of second correction values respectively corresponding to the second pixel sets, and wherein the second number is greater than the first number.

In the above method, the first applying further comprises multiplying the input image data of each of the first pixel sets by the corresponding first correction value so as to generate the first modified image data, wherein the second applying further comprises multiplying the input image data of each of the second pixel sets by the corresponding second correction value so as to generate the second modified image data.

In the above method, the second applying comprises dividing the second pixels formed in an outer portion of the second region into a plurality of second outer pixel sets each including a number of pixels which is less than the second number.

In the above method, the first applying comprises dividing the first pixels into a plurality of third pixel sets each including a third number of pixels and determining a plurality of first image processing masks respectively corresponding to the third pixel sets, wherein the second applying comprises dividing the second pixels into a plurality of fourth pixel sets each including a fourth number of pixels and determining a plurality of second image processing masks respectively corresponding to the fourth pixel sets, and wherein the fourth number is greater than the third number.

In the above method, the display panel further includes a plurality of boundary pixels, wherein the boundary pixels form a boundary region surrounding the first region, and wherein the second region surrounds the boundary region, wherein the boundary region comprises a first boundary region including a plurality of first boundary pixels and a second boundary region including a plurality of second boundary pixels, and wherein the method further comprises i) third applying the first image processing algorithm to the input image data corresponding to first boundary pixels and ii) fourth applying the second image processing algorithm to image data corresponding to pixels formed in the second boundary region, from among the input image data so as to generate modified boundary image data, wherein the third and fourth applying are performed by the controller.

In the above method, the first and second boundary regions are formed in the boundary region in a mosaic form.

In the above method, the first region is substantially circular, oval, square, or polygonal and formed in a center portion of the display panel, wherein the boundary region has the shape of a substantially circular ring, a substantially oval ring, a substantially square ring, or a polygonal ring, and wherein the second region has the shape of one of a substantially circular ring, a substantially oval ring, a substantially square ring, or a polygonal ring.

In the above method, the first region is substantially circular, oval, square, or polygonal and formed in a center portion of the display panel, and wherein the second region has the shape of a substantially circular ring, a substantially oval ring, a substantially square ring, or a polygonal ring.

DETAILED DESCRIPTION OF CERTAIN INVENTIVE EMBODIMENTS

Figure 1:
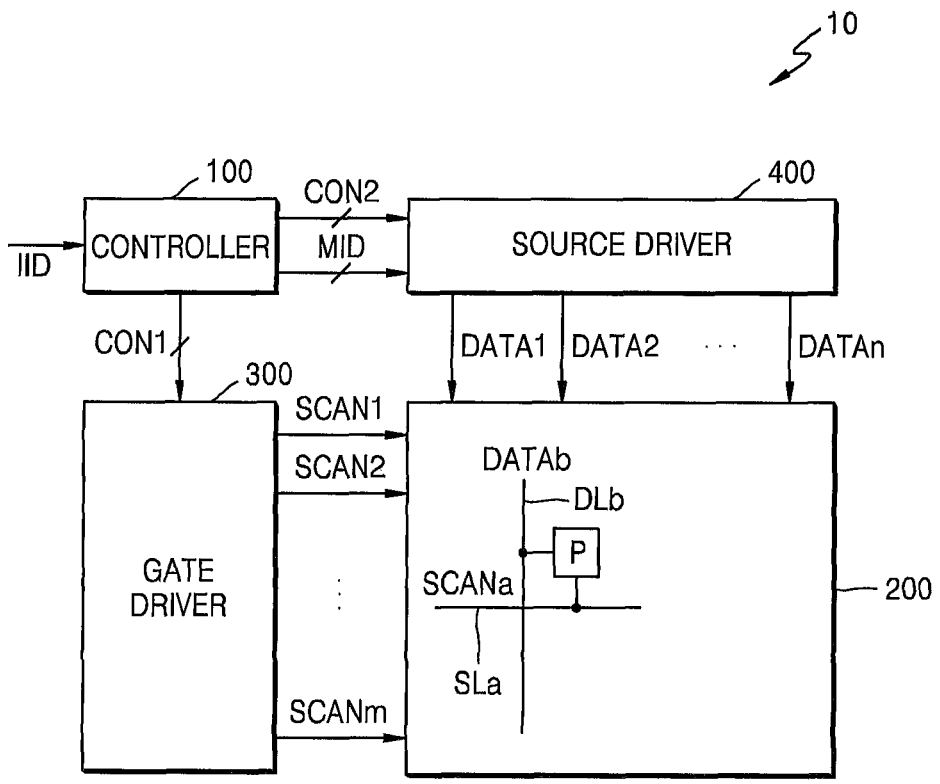
FIG. 1 is a schematic view of a display device according to an exemplary embodiment.

Reference will now be made in detail to exemplary embodiments, examples of which are illustrated in the accompanying drawings, wherein like reference numerals refer to like elements throughout. In this regard, the present exemplary embodiments can have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Since the described technology can have various modifications and several embodiments, exemplary embodiments are shown in the drawings and will be described in detail. Advantages, features, and a method of achieving the same will be specified with reference to the embodiments described below in detail together with the attached drawings. However, the embodiments can have different forms and should not be construed as being limited to the descriptions set forth herein.

The exemplary embodiments of the present disclosure will be described below in more detail with reference to the accompanying drawings. Those components that are the same or are in correspondence are rendered the same reference numeral regardless of the figure number, and redundant explanations are omitted.

It will be understood that although the terms "first", "second", etc. can be used herein to describe various components, these components should not be limited by these terms. These components are only used to distinguish one component from another. Singular expressions, unless defined otherwise in contexts, include plural expressions. In the embodiments below, it will be further understood that the terms "comprise" and/or "have" used herein specify the presence of stated features or components, but do not preclude the presence or addition of one or more other features or components.

The use of the terms "a" and "an" and "the" and similar referents in the context of describing the described technology (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein.

The steps of all methods described herein can be performed in any suitable order unless otherwise indicated herein or otherwise clearly contradicted by context. The use of any and all examples, or exemplary language (e.g., "such as") provided herein, is intended merely to better illuminate the described technology and does not pose a limitation on the scope of the described technology unless otherwise claimed. Numerous modifications and adaptations will be readily apparent to those skilled in this art without departing from the spirit and scope of the described technology. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a schematic block diagram illustrating a display device 10 according to an exemplary embodiment.

Referring to FIG. 1, the display device 10 includes a controller 100, a display unit (or display panel) 200, a gate driver 300, and a source driver 400. The controller 100, the gate driver 300, and/or the source driver 400 can be respectively formed on separate semiconductor chips or can be integrated to a single semiconductor chip. Also, the gate driver 300 and/or the source driver 400 can be formed on the same substrate as the display unit 200. The display device 10 can be an image display component of an electronic device such as a smartphone, a tablet personal computer (PC), a notebook PC, a monitor or a TV.

A pixel P can be a unit for color representation for displaying various colors. A pixel P can be formed of a combination of a color filter and liquid crystals, a combination of a color filter and an OLED, or of an OLED, according to a type of a display device, and is not limited thereto. A pixel P can include a plurality of subpixels. In the present specification, a pixel P can refer to a subpixel or a unit pixel including a plurality of subpixels.

The display device 10 can receive a plurality of image frames from an external device. When a plurality of image frames are sequentially displayed, a video can be displayed. Each of the image frames can include an input image data IID. Input image data IID includes information about luminance of light emitted through a pixel P, and the number of bits of input image data IID can be determined according to a set level of luminance. For example, the input image data IID is an 8-bit digital signal to display a grayscale range of 256 luminance levels. In this case, if the darkest grayscale of the display unit 200 corresponds to a first level and the brightest grayscale corresponds to a 256th level, input image data IID corresponding to the first level can be 0, and input image data IID corresponding to level the 256th level can be 255.

The controller 100 can be connected to the display unit 200, the gate driver 300, and the source driver 400. The controller 100 can control the display unit 200, the gate driver 300, and the source driver 400 so as to operate the display device 10. The controller 100 can receive input image data IID, and can output first control signals CON1 to the gate driver 300. The first control signals CON1 can include a horizontal synchronization signal HSYNC. The first control signals CON1 can include control signals needed for the gate driver 300 to output scan signals SCAN1 through SCANm substantially synchronized with a horizontal synchronization signal HSYNC. The controller 100 can output second control signals CON2 to the source driver 400. The second control signals CON2 can include control signals needed for the source driver 400 to substantially synchronize data signals DATA1 through DATAn with the scan signals SCAN1 through SCANm and output the data signals DATA1 through DATAn substantially synchronized with the scan signals SCAN1 through SCANm.

The controller 100 can output modified image data MID to the source driver 400. The modified image data MID can be image data generated by correcting input image data IID received from the outside. The second control signals CON2 can include control signals needed for the source driver 400 to output data signals DATA1 through DATAn corresponding to the modified image data MID. The modified image data MID can include image information needed to generate data signals DATA1 through DATAn. The modified image data MID can include image data corresponding to respective pixels P displayed on the display unit 200.

The display unit 200 can include a plurality of pixels, a plurality of scan lines each connected to pixels of a row of the pixels, and a plurality of data lines connected to pixels of a column of pixels. For example, as illustrated in FIG. 1, the display unit 200 includes a pixel P included among the plurality of pixels, and includes a first scan line SCANa connected to all pixels on a row, on which the pixel P is located among the pixels, and a first data line DATAb connected to all pixels of a column, on which the pixel P is located among the pixels.

The gate driver 300 can output scan signals SCAN1 through SCANm to the scan lines. The gate driver 300 can output scan signals SCAN1 through SCANm by substantially synchronizing them with a vertical synchronization signal. The source driver 400 can output data signals DATA1 through DATAn to the data lines in synchronization with the scan signals SCAN1 through SCANm. The source driver 400 can output to the data lines data signals DATA1 through DATAn that are substantially proportional to received image data.

Figure 2:
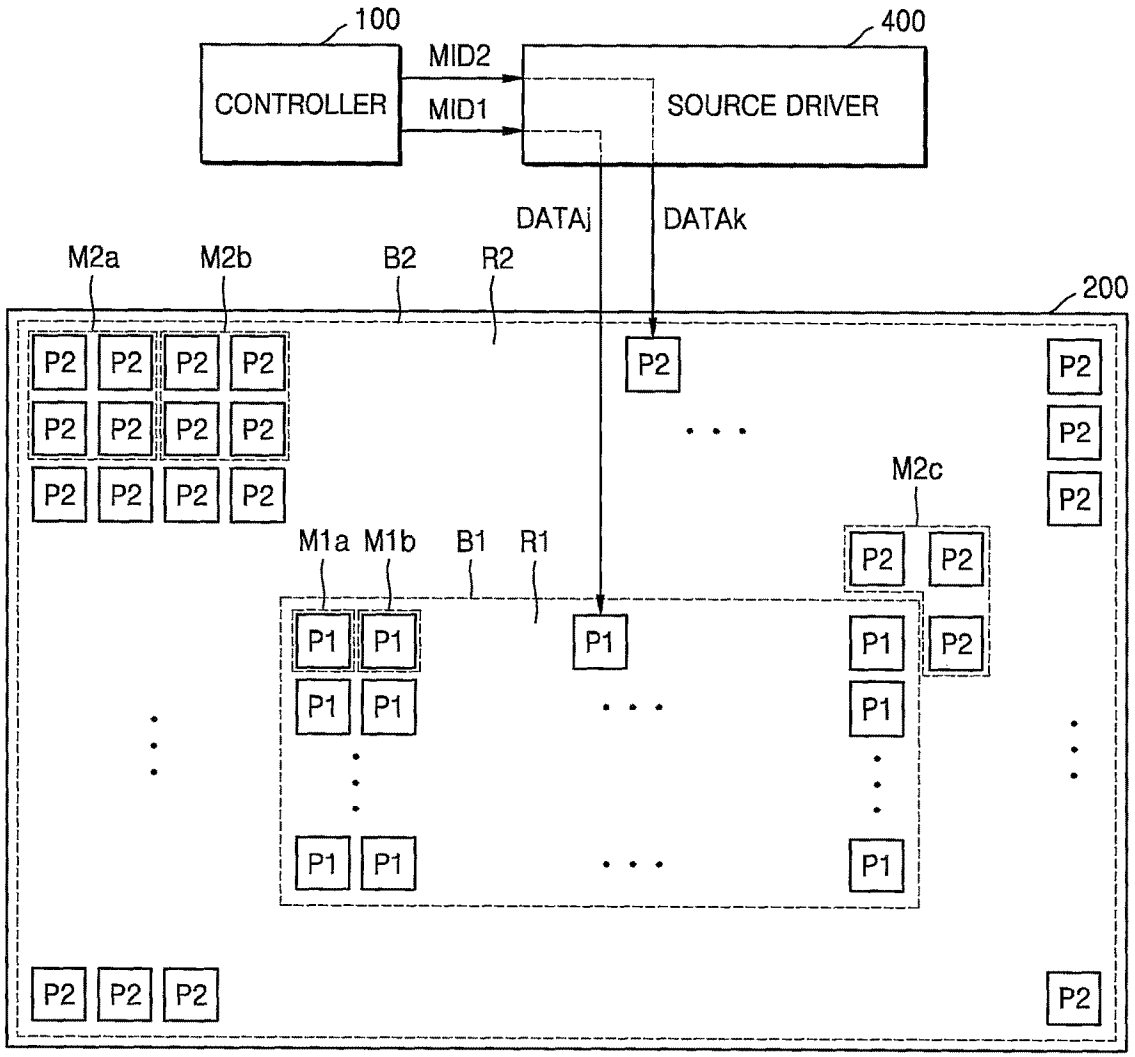
FIG. 2 is a schematic view of a display device according to another exemplary embodiment.

FIG. 2 is a schematic view of a display device according to another exemplary embodiment.

Referring to FIG. 2, the display unit 200 includes first pixels P1 and second pixels P2. The controller 100 can output first modified image data MID1 corresponding to one of the first pixels P1, and the source driver 400 can supply a data voltage corresponding to the first modified image data MID1, to the pixel to which the first modified image data MID1 corresponds. The controller 100 can output second modified image data MID2 corresponding to one of the second pixels P2, and the source driver 400 can supply a data voltage corresponding to the second modified image data MID2 to the pixel to which the second modified image data MID2 corresponds.

The display unit 200 can include a first region R1 and a second region R2. In detail, a portion of the display unit 200 can be surrounded by a first boundary B1, and a region that is larger than the first boundary B1 and includes the first boundary B1 can be surrounded by a second boundary B2. The first region R1 can be a region inside the first boundary B1, and the second region R2 can be a region inside the second boundary B2 and outside the first boundary B1. The first and second boundaries B1 and B2 can be boundaries that divide the display unit 200 into logical regions or can be boundaries that are not physically marked on the display unit 200.

The first pixels P1 can be pixels P formed in the first region R1. Also, the second pixels P2 can be pixels P formed in the second region R2. The first and second pixels P1 and P2 can be divided into logical regions based on respective positions thereof, and in some embodiments, are not divided according to a method of manufacturing the pixels or according to physical characteristics of the pixels.

The controller 100 can output first modified image data MID1 corresponding to one of the first pixels P1. Also, the controller 100 can output second modified image data MID2 corresponding to one of the second pixels P2. The first and second modified image data MID1 and MID2 can be generated by applying different image processing algorithms to input image data according to whether a pixel corresponding to respective image data is one of the first pixels P1 or one of the second pixels P2. For example, the controller 100 generates first modified image data MID1 by applying a first image processing algorithm to image data corresponding to the first pixels P1, from among input image data IID, and can generate second modified image data MID2 by applying a second image processing algorithm to image data corresponding to the second pixels P2, from among the input image data IID.

The controller 100 can divide the first pixels P1 into a plurality of pixel sets M1, each formed of a first number of pixels, and divide the second pixels P2 into a plurality of pixel sets M2, each formed of a second number of pixels. Each of the pixel sets M1 can be formed of a first number of first pixels P1, and each of the pixel sets M2 can be formed of a second number of second pixels P2. For example, the controller 100 divides the first pixels P1 into pixel sets M1 each formed of one pixel, and divide the second pixels P2 into pixel sets M2 each formed of four pixels arranged in a 2×2 form. Although the first number of pixels P1 is set to one and the second number of pixels P1 is set to four in the present exemplary embodiment, the exemplary embodiments are not limited thereto, and any first number and any second number satisfying a condition that the second number is greater than the first number can be applied. Also, among the first pixels P1 in the first region R1, first pixels P1 that are included in an outer portion of the first region R1, that is, first pixels P1 that are adjacent to the first boundary B1, can be divided into a pixel set M1 formed of a number of first pixels P1 that is less than the first number if the first number is greater than one. Likewise, the second pixels P2 that are adjacent to an outer portion of the second region R2, that is, to the first boundary B1 or the second boundary B2, can be divided into a pixel set M2 formed of a number of second pixels P2 which is less than the second number. For example, three second pixels P2 adjacent to the first boundary B1 form a pixel set M2*c*, and the pixel set M2*c* is included in the pixel set M2.

The controller 100 can set a substantially identical compensation value to pixels P included in the same pixel set. For example, if a pixel set M1*a* and a pixel set M1*b* are included in the pixel set M1, the controller 100 sets a compensation value 1*a* for first pixels P1 included in the pixel set M1*a*, and a compensation value 1*b* for first pixels P1 included in the pixel set M1*b*. Also, if a pixel set M2*a* and a pixel sets M2*b* are included in the pixel set M2, the controller 100 can set a compensation value 2*a* for second pixels P2 included in the pixel set M2*a*, and a compensation value 2*b* for second pixels P2 included in the pixel sets M2*b*. Each compensation value can be determined based on characteristics of pixels included in each pixel set. Examples of characteristics of pixels include physical characteristics of each pixel, degree of imbalance between pixels caused during the manufacture of the pixels, and physical characteristics generated according to positions of the pixels (e.g., a difference in degrees of voltage drops). Each compensation value can be identical or different. Accordingly, pixels included in a pixel set can have substantially the same compensation value.

The controller 100 can generate modified image data MID by multiplying input image data IID by a compensation value. The compensation value multiplied by the input image data IID can be a compensation value set to a pixel to which each input image data IID corresponds. For example, the controller 100 generates modified image data MID corresponding to a first pixel P1 by multiplying input image data IID corresponding to the first pixel P1 included in the pixel set M1*a* by a compensation value 1*a* which is a compensation value of the first pixel P1 included in the a pixel set M1*a*. Also, the controller 100 can generate modified image data MID respectively corresponding to four second pixels P2 by multiplying input image data IID respectively corresponding to the four second pixels P2 by a compensation value 2*a* which is a compensation value of the second pixels P2 included in the pixel set M2*a*.

The controller 100 can generate modified image data MID by applying the same type of image processing algorithm to input image data IID corresponding to the pixels P included in the same type of pixel set. For example, the controller 100 generates modified image data MID by applying a first image processing algorithm to input image data IID corresponding to first pixels P1 included in pixel sets M1, and generates modified image data MID by applying a second image processing algorithm to input image data IID corresponding to second pixels P2 included in pixel sets M2. The first and second image processing algorithms can include an operation of using an image processing mask. That is, the first image processing algorithm can include an operation of determining first image processing masks respectively corresponding to pixel sets M1 and an operation of performing image processing by using the image processing masks, and the second image processing algorithm can include an operation of determining second image processing masks respectively corresponding to pixel sets M2 and an operation of performing image processing by using the image processing masks. The image processing masks can have a shape in which a plurality of elements are formed in a matrix. Also, the number of elements included in a first image processing mask can be the same as the number of first pixels P1 included in a pixel set M1, and the number of elements included in a second image processing mask can be the same as the number of second pixels P2 included in a pixel set M2. The number of elements of the image processing masks can be different according to respective pixel sets. For example, when a pixel set M1*a* and a pixel set M1*b* are included in the pixel set M1, a pixel set M2*a* and a pixel sets M2*b* are included in the pixel set M2 can be considered. In this case, the controller 100 can generate modified image data MID by applying a first image processing algorithm, in which a 1*a* image processing mask is used for input image data IID corresponding to the first pixels P1 included in the pixel set M1*a* and a 1*b* image processing mask is used for input image data IID corresponding to the first pixels P1 included in the pixel set M1*b*. Also, the controller 100 can generate modified image data MID by applying a second image processing algorithm in which a 2*a* image processing mask is used for input image data IID corresponding to the second pixels P2 included in the pixel set M2*a* and a 2*b* image processing mask is used for input image data IID corresponding to the second pixels P2 included in the pixel sets M2*b*.

The source driver 400 can supply data voltages respectively corresponding to first and second modified image data MID1 and MID2 to pixels to which the first and second modified image data MID1 and MID2 correspond. For example, the source driver 400 syookues a first data voltage DATAj that is substantially proportional to the first modified image data MID1 corresponding to a predetermined first pixel P1 included in the first region R1, to the first pixel P1, and a second data voltage DATAk that is substantially proportional to the second modified image data MID2 corresponding to a predetermined second pixel P2 included in the second region R2, to the second pixel P2.

Although the first region R1 has a square shape, and the second region R2 has a square ring shape in FIG. 2, the exemplary embodiments are not limited thereto. The first region R1 can have a shape of one of substantially a circle, an oval, a square, and a polygonal shape that is not a square, formed in a center portion of the display unit 200. Also, the second region R2 can have a shape that does not overlap the first region R1 and is of one of a substantially circular ring, a substantially oval ring, a square ring, and a polygonal ring shape that is not a square ring shape. Also, while the display unit 200 is divided into the first and second regions R1 and R2 in FIG. 2, the exemplary embodiments are not limited thereto. That is, the display unit 200 can include the first and second regions R1 and R2, and also can further include a third region that surrounds the second region R2, or can also be divided into four or more regions.

When setting a coefficient for optical compensation for each pixel P included in the display unit 200, the same number of coefficients as the total number of pixels P are to be stored. In this case, memory needed to store the coefficients is increased. However, if multiple pixel sets are set by dividing the pixels P included in the display unit 200 into pixel sets of a predetermined number of pixels, and one coefficient for optical compensation is set for each pixel set, memory needed for storing coefficients can be reduced. The problem here is that boundaries between the pixel sets can appear unnatural to an user of the display device 10. Thus, according to the exemplary embodiment, pixels in different regions in the display device 10 can be driven differently in comparison to one another, which can be accomplished by setting the coefficient for optical compensation of each of all pixels P included in a predetermined region in the display device 10, based on the regions. For example, if one region is a region which a user views in detail, a region which the user views frequently, a region which a user views from a relatively near distance, a region having a relatively small pixel per inch (PPI), or a region with individual pixels that have a relatively large size, the pixels included in the region can be divided into pixel sets including a relatively small number of pixels P.

Figure 3:
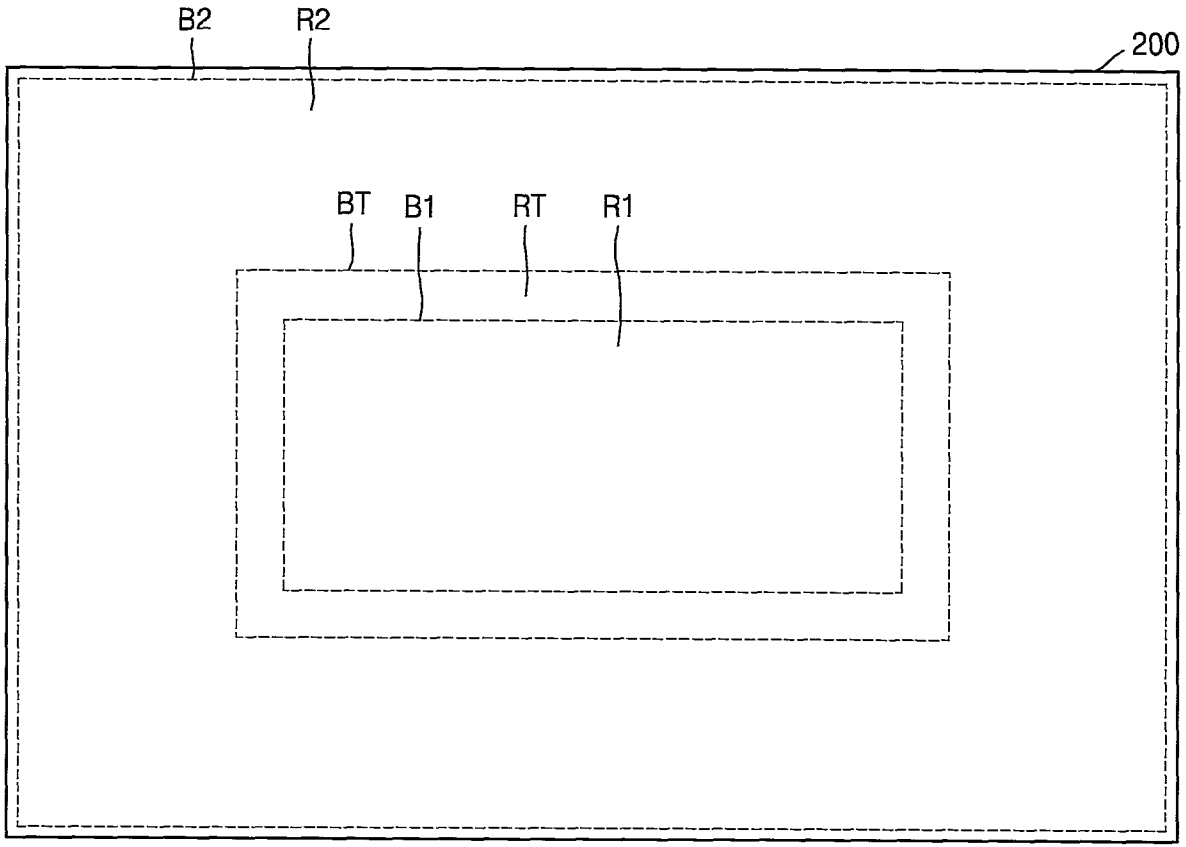
FIG. 3 is a schematic view of a display unit illustrated in FIG. 1 according to an exemplary embodiment.

FIG. 3 is a schematic view of the display unit 200 illustrated in FIG. 1 according to an exemplary embodiment.

Referring to FIG. 3, the display unit 200 includes a first region R1, a second region R2, and a transition region RT. In detail, a portion of the display unit 200 can be surrounded by a first boundary B1, and a region that includes the first boundary B1 can be surrounded by a transition region BT, and a region that includes the transition boundary BT can be surrounded by a second boundary B2. The first region can be inside the first boundary B1, and the transition region RT can be a region inside the transition boundary BT and outside the first boundary B1, and the second region R2 can be a region inside the second boundary B2 and outside the transition boundary BT. The first region B1, the second region B2, and the transition region BT can be regions that are logically distinguished on the display unit 200 or can be boundaries that are not physically marked on the display unit 200.

FIG. 3 illustrates the first region R1 having a square shape and the second region R2 and the transition region RT having a square ring shape, but the exemplary embodiments are not limited thereto. The first region R1 can have a shape of one of substantially a circle, an oval, a square, and a polygonal shape that is not a square, formed in the center portion of the display unit 200. Also, the transition region RT can have a shape that does not overlap the first region R1 and is one of a substantially circular ring, a substantially oval ring, a square ring, and a polygonal ring shape that is not a square ring shape. Also, the second region R2 can have a shape that does not overlap the transition region R1 and is one of a substantially circular ring, a substantially oval ring, a square ring, and a polygonal ring shape that is not a square ring shape. Also, while the display unit 200 is divided into the first region B1, the second region B2, and the transition region BT, the exemplary embodiments are not limited thereto. That is, the display unit 200 can include a first region R1, a second region R2, and a first transition region RT, and can further include a second transition region surrounding the second region R2 and a third region surrounding the second transition region. Furthermore, the display unit 200 can include four or more regions and transition regions formed between these regions.

A method of setting pixel sets for pixels of a display unit illustrated in FIGS. 4A through 4E is exemplary. That is, when setting pixel sets for pixels of a display unit in order to drive a display device, various pixel sets can be set such as a square shape including m pixels in a horizontal direction and n pixels in a vertical direction, a polygonal shape other than a square shape or a shape that can be set in consideration of subpixels.

When generating modified image data by applying a first image processing algorithm to input image data corresponding to first pixels P1 included in a first region R1 and modified image data by applying a second image processing algorithm to input image data corresponding to second pixels P2 included in a second region R2, if the first region R1 and the second region R2 are adjacent to each other, a boundary between the first and second regions R1 and R2 can be viewed unnaturally to the user. Thus, a transition region RT can be set between the first and second regions R1 and R2, and the first image processing algorithm can be applied to some pixels included in the transition region RT, and the second image processing algorithm can be applied to the rest of pixels. A detailed method of applying the first and second image processing algorithms will be described with reference to FIGS. 4A through 4E.

FIGS. 4A through 4E are schematic views illustrating a method of setting pixel sets for pixels of the display unit 200 according to an exemplary embodiment.

Figure 4A:
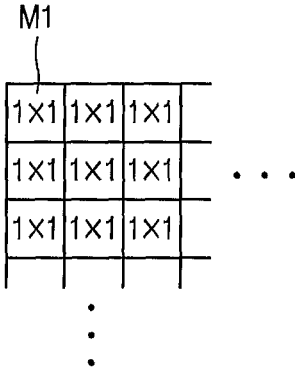
FIGS. 4A, 4B, 4C, 4D and 4E are schematic views illustrating a method of setting pixel sets of a display unit according to an exemplary embodiment.
Figure 4B:
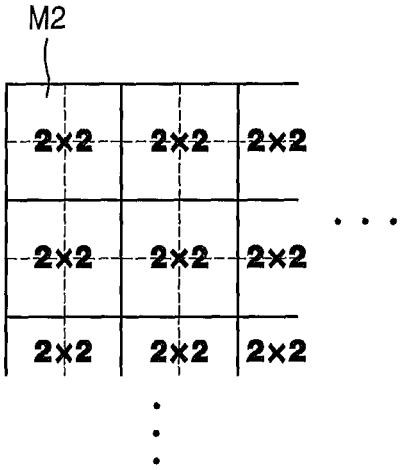
Figure 4C:
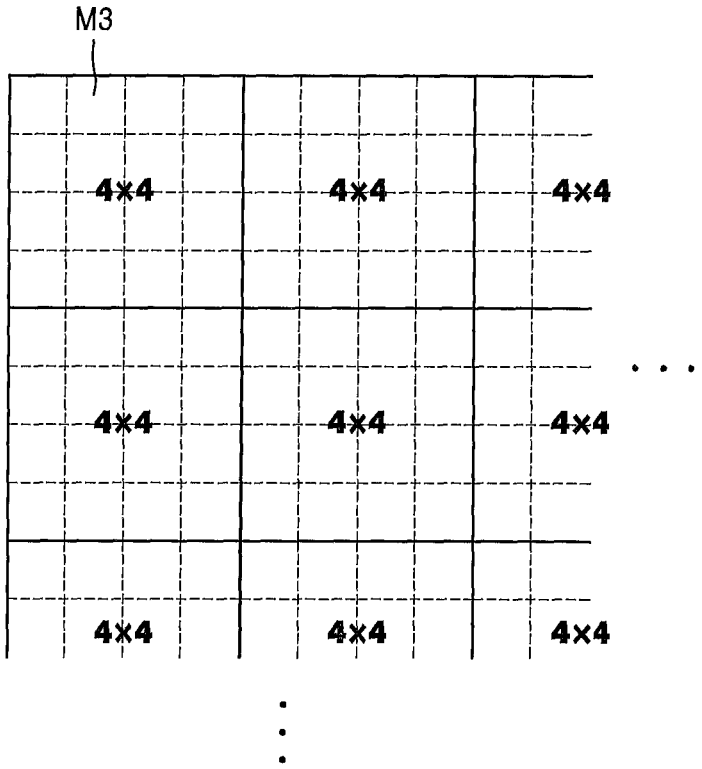
Figure 4D:
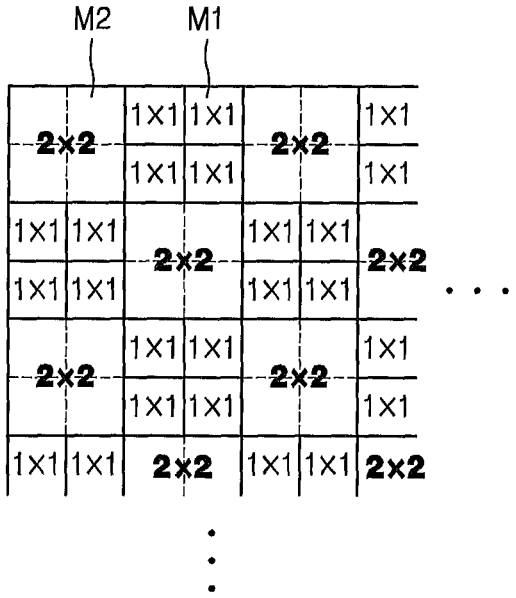
Figure 4E:
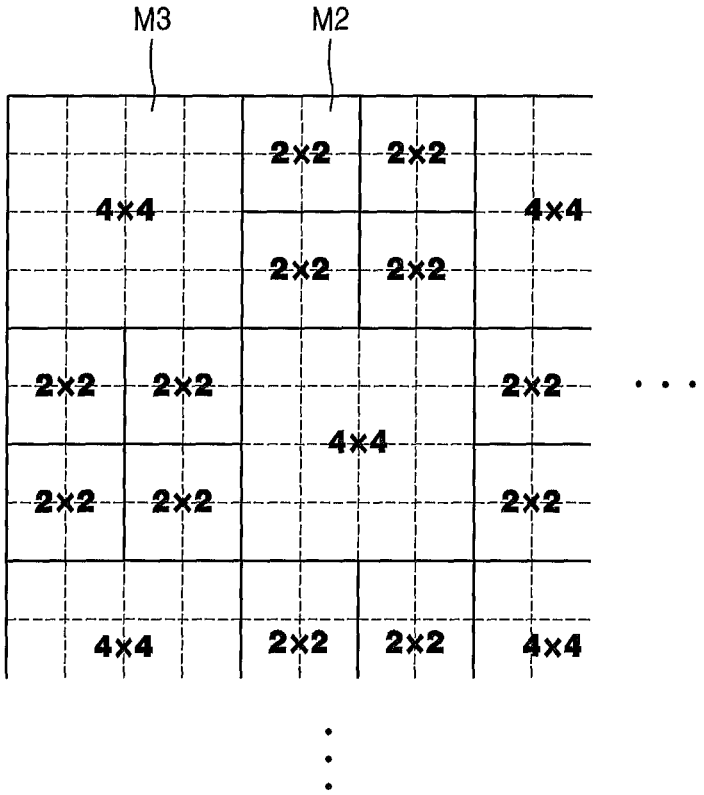

Referring to FIGS. 4A through 4E, pixels P formed in the first region R1 or the second region R2 are divided into a plurality of pixel sets as illustrated in one of FIGS. 4A through 4C. Pixels P arranged in the transition region RT of the display unit 200 can be divided into a plurality of pixel sets as shown in FIG. 4D or 4E.

The pixels P formed in the first region R1 of the display unit 200 can be divided into pixel sets M1 each formed of one pixel as illustrated in FIG. 4A. That is, each pixel P can be a pixel set. Also, the pixels formed in the first region R1 or the second region R2 of the display unit 200 can be divided into pixel sets M2 each formed of four pixels arranged in a 2×2 form as illustrated in FIG. 4B. Also, the pixels P formed in the first region R1 or the second region R2 of the display unit 200 can be divided into third pixel sets M3 each formed of sixteen pixels arranged in a 4×4 form as illustrated in FIG. 4C. Also, the transition region (or boundary region) RT of the display unit 200 can be divided into a first boundary region and a second boundary region, and pixels formed in the first boundary region can be divided into pixel sets of the same form as the pixels P formed in the first region R1, and pixels formed in the second boundary region can be divided into pixel sets of the same form as the pixels P formed in the second region R2. For example, the pixels P formed in the first region R1 are divided into the pixel sets M1, and the pixels P formed in the second region R2 are divided into the pixel sets M2. In this case, the pixels P formed in the transition region RT can be divided into pixel sets M1 and pixel sets M2 that are arranged in a two-dimensional mosaic form as illustrated in FIG. 4D. As another example, the pixels P formed in the first region R1 are divided into pixel sets M2, and the pixels P formed in the second region R2 are divided into third pixel sets M3. In this case, the pixels P formed in the transition region RT can be divided into pixel sets M2 and third pixel sets M3 arranged in a two-dimensional mosaic form as illustrated in FIG. 4E. Accordingly, respective boundary portions of the first and second region R1 and R2 can be spaced apart from each other, and a degree that the adjacent boundary portions appear unnatural to the viewer can be reduced.

The method of setting pixel sets for pixels of the display unit 200 illustrated in FIGS. 4A through 4E is exemplary. That is, when setting pixel sets for pixels of a display unit to drive a display device, various pixel sets such as a square shaped pixel set including m pixels in a horizontal direction and n pixels in a vertical direction, a polygonal shaped pixel set other than a square shaped pixel set, or a pixel set that is shaped in consideration of subpixels can be set.

Figure 5:
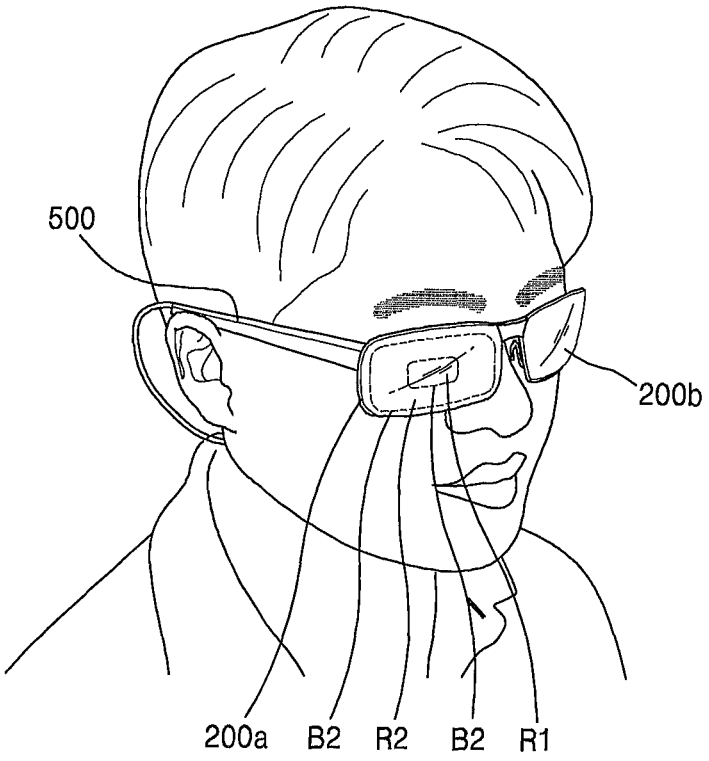
FIG. 5 is a schematic view of a display device according to an exemplary embodiment, including a display device fixing unit, according to an exemplary embodiment.

FIG. 5 is a schematic view of a display device including a display device fixing unit (or display device support) 500, according to an exemplary embodiment.

Referring to FIG. 5, the display device 10 further includes the display device fixing unit 500. The display device fixing unit 500 is used to fix the display device 10 on the head of a user such that the display unit 200 of the display device 10 is fixed in front of two eyes of the user. When the display device 10 includes two display units 200, the display device fixing unit 500 can be used to fix the display device 10 on the head of the user such that the display units 200 are fixed respectively in front of the left eye and the right eye of the user. For example, the display device fixing unit 500 fixes a first display unit 200*a* before the right eye of the user, and fix a second display unit 200*b* before the left eye of the user. The display device fixing unit 500 can be in various forms such as a rim of a pair of glasses, a hair band, or a helmet.

When the display device 10 is supported by using the display device fixing unit 500 such that the display device 10 is in front of the eyes of the user, a center portion of the display unit 200 can be positioned in front of the eyes of the user, and an outer portion of the display unit 200 can be positioned such that the output portion is not directly in front of the eyes of the user. In this case, the distance from the eyes of the user to the center portion of the display unit 200 can be less than the distance from the eyes of the user to the outer portion of the display unit 200. Accordingly, the user can perceive the pixels formed in the center portion of the display unit 200 to be larger than the pixels formed in the outer portion of the display unit 200. Also, the center portion of the display unit 200 can be a region where the user observes relatively often or in detail. Thus, when driving the display device 10 according to the exemplary embodiments, optical compensation can be performed on the pixels formed in the center portion of the display unit 200 relatively precisely, and optical compensation whereby a relatively small amount of memory is consumed can be performed on the pixels formed in the outer portion of the display unit 200.

Figure 6:
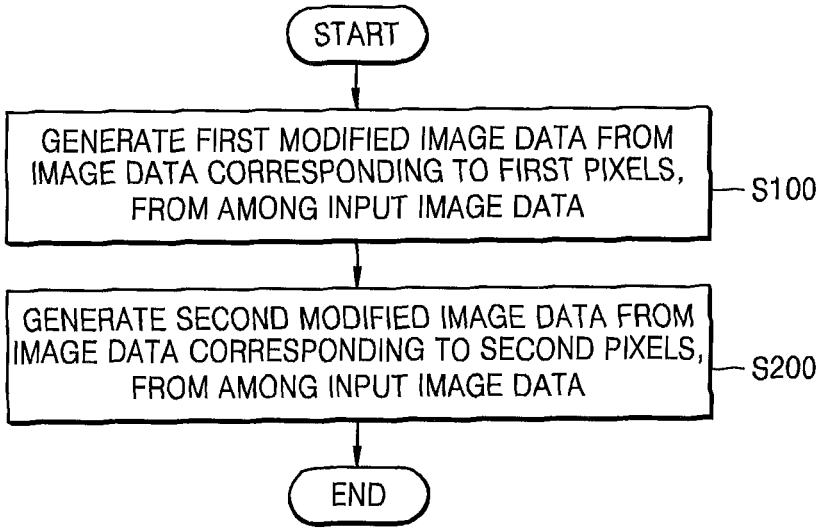
FIG. 6 is a flowchart of a method of driving a display device according to an exemplary embodiment.

FIG. 6 is a flowchart of a method of driving a display device according to an exemplary embodiment. Details that are provided above with reference to FIGS. 1 through 5 will be omitted herein.

In some embodiments, the FIG. 6 procedure is implemented in a conventional programming language, such as C or C++ or another suitable programming language. The program can be stored on a computer accessible storage medium of the display device 10, for example, a memory (not shown) of the display device 10 or the controller 100. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 6.

Referring to FIG. 6, the method of driving a display device includes an operation of generating, by using a controller, first modified image data from image data corresponding to first pixels, from among input image data (S100) and an operation of generating, by using the controller, second modified image data from image data corresponding to second pixels, from among the input image data (S200). The image data corresponding to the first or second pixels can be input image data that is input to the display device from the outside or an external device.

According to at least one of the disclosed embodiments, optical compensation is performed by applying an image processing algorithm determined based on positions of pixels respectively corresponding to image data.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While the inventive technology has been described with reference to the figures, it will be understood by those of ordinary skill in the art that various changes in form and details can be made therein without departing from the spirit and scope as defined by the following claims.

What is claimed is:

1. A display device, comprising:

a display panel comprising a plurality of pixels including a first group of pixels and a second group of pixels, wherein the first group of pixels form a first region and the second group of pixels form a second region fully surrounding the first region; and a controller configured to i) receive input image data, ii) process the input image data corresponding to the first group of pixels based on a preset first image processing algorithm so as to generate first modified image data, and iii) process the input image data corresponding to the second group of pixels based on a preset second image processing algorithm so as to generate second modified image data, wherein the first region is formed in a center portion of the display panel, and the second region has the shape of a substantially circular ring, a substantially oval ring, a substantially square ring, or a polygonal ring, wherein the pixels include a plurality of boundary pixels, wherein the boundary pixels form a boundary region, wherein the boundary region surrounds the first region, wherein the second region surrounds the boundary region, wherein the boundary region comprises a first boundary region including a plurality of first boundary pixels and a second boundary region including a plurality of second boundary pixels, wherein the controller is further configured to i) apply the first image processing algorithm to the input image data corresponding to the first boundary pixels and ii) apply the second image processing algorithm to the input image data corresponding to the second boundary pixels, so as to generate modified boundary image data, wherein the first and second boundary regions are formed in the boundary region in a mosaic form, wherein the first group of pixels formed in the first region are divided into a first pixel set arranged in an n×n form, wherein the second group of pixels formed in the second region are divided into a second pixel set arranged in an m×m form, and wherein the first and second boundary regions having the mosaic form comprise the first pixel set and the second pixel set alternately arranged in vertical and horizontal directions.

2. The display device of claim 1, wherein the first image processing algorithm is configured to divide the first group pixels into a plurality of first pixel sets each including a first number of pixels and determine a plurality of first correction values respectively corresponding to the first pixel sets, wherein the second image processing algorithm is configured to divide the second group of pixels into a plurality of second pixel sets each including a second number of pixels and determine a plurality of second correction values respectively corresponding to the second pixel sets, and wherein the second number is greater than the first number.

3. The display device of claim 2, wherein the first image processing algorithm is further configured to multiply the input image data of each of the first pixel sets by the corresponding first correction value so as to generate the first modified image data, and wherein the second image processing algorithm is further configured to multiply the input image data of each of the second pixel sets by the corresponding second correction value so as to generate the second modified image data.

4. The pixel device of claim 2, wherein the second image processing algorithm is further configured to divide the second group of pixels formed in an outer portion of the second region into a plurality of second outer pixel sets each including a number of the pixels which is less than the second number.

5. The display device of claim 1, wherein the first image processing algorithm is configured to divide the first group of pixels into a plurality of third pixel sets each including a third number of pixels and determine a plurality of first image processing masks respectively corresponding to the third pixel sets, wherein the second image processing algorithm is configured to divide the second group of pixels into a plurality of fourth pixel sets each including a fourth number of pixels and determine a plurality of second image processing masks respectively corresponding to the fourth pixel sets, and wherein the fourth number is greater than the third number.

6. The display device of claim 1, wherein the first region is substantially circular, oval, square, or polygonal, wherein the boundary region has the shape of a substantially circular ring, a substantially oval ring, a substantially square ring, or a polygonal ring.

7. The display device of claim 1, wherein the first region is substantially circular, oval, square, or polygonal.

8. The display device of claim 1, further comprising a display device support configured to support the display device such that the display panel is located in front of at least one of the left and right eyes of a user of the display device.

9. A method of driving a display device, the display device comprising a display panel including a plurality of first pixels that form a first region and a plurality of second pixels that form a second region, the method comprising:

receiving input image data at a controller electrically connected to the display panel and configured to generate modified image data from the input image data;

first applying a preset first image processing algorithm to process the input image data corresponding to the first pixels via the controller so as to generate first modified mage data; and second applying a preset second image processing algorithm to process the input image data corresponding to the second pixels via the controller so as to generate second modified image data, wherein the second region does not overlap the first region and fully surrounds the first region, wherein the first region is formed in a center portion of the display panel, and the second region has the shape of a substantially circular ring, a substantially oval ring, a substantially square ring, or a polygonal ring, wherein the pixels include a plurality of boundary pixels, wherein the boundary pixels form a boundary region, wherein the boundary region surrounds the first region, wherein the second region surrounds the boundary region, wherein the boundary region comprises a first boundary region including a plurality of first boundary pixels and a second boundary region including a plurality of second boundary pixels, wherein the method further comprises i) third applying the first image processing algorithm to the input image data corresponding to first boundary pixels and ii) fourth applying the second image processing algorithm to image data corresponding to pixels formed in the second boundary region, from among the input image data so as to generate modified boundary image data, wherein the third and fourth applying are performed by the controller, wherein the first and second boundary regions are formed in the boundary region in a mosaic form, wherein the first group of pixels formed in the first region are divided into a first pixel set arranged in an n×n form, wherein the second group of pixels formed in the second region are divided into a second pixel set arranged in an m×m form, and wherein the first and second boundary regions having the mosaic form comprise the first pixel set and the second pixel set alternately arranged in vertical and horizontal directions.

10. The method of claim 9, wherein the first applying comprises dividing the first pixels into a plurality of first pixel sets each formed of a first number of pixels and determining a plurality of first correction values respectively corresponding to the first pixel sets, wherein the second applying comprises dividing the second pixels into a plurality of second pixel sets each including a second number of pixels and determining a plurality of second correction values respectively corresponding to the second pixel sets, and wherein the second number is greater than the first number.

11. The method of claim 10, wherein the first applying further comprises multiplying the input image data of each of the first pixel sets by the corresponding first correction value so as to generate the first modified image data, and wherein the second applying further comprises multiplying the input image data of each of the second pixel sets by the corresponding second correction value so as to generate the second modified image data.

12. The method of claim 10, wherein the second applying comprises dividing the second pixels formed in an outer portion of the second region into a plurality of second outer pixel sets each including a number of pixels which is less than the second number.

13. The method of claim 9, wherein the first applying comprises dividing the first pixels into a plurality of third pixel sets each including a third number of pixels and determining a plurality of first image processing masks respectively corresponding to the third pixel sets, wherein the second applying comprises dividing the second pixels into a plurality of fourth pixel sets each including a fourth number of pixels and determining a plurality of second image processing masks respectively corresponding to the fourth pixel sets, and wherein the fourth number is greater than the third number.

14. The method of claim 9, wherein the first region is substantially circular, oval, square, or polygonal, wherein the boundary region has the shape of a substantially circular ring, a substantially oval ring, a substantially square ring, or a polygonal ring.

15. The method of claim 9, wherein the first region is substantially circular, oval, square, or polygonal.

16. The display device of claim 1, wherein the first region has four sides connected to one another, and wherein the second region fully surrounds the four sides of the first region.

* * * * *